US005651257A

United States Patent [19]

Kasahara et al.

[11] Patent Number: 5,651,257

[45] Date of Patent: Jul. 29, 1997

[54] WORKING FLUID COMPOSITION AND METHOD FOR LUBRICATING AMMONIA REFRIGERATING MACHINE

[75] Inventors: Keisuke Kasahara, Tokyo; Kuniaki Kawamura, Ibaragi-ken; Takashi Kaimai; Hisashi Yano, both of Saitama-ken, all of Japan

[73] Assignee: Japan Energy Corporation & Mayekawa Manufacturing Co. Ltd., Tokyo, Japan

[21] Appl. No.: 469,707

[22] Filed: Jun. 6, 1995

Related U.S. Application Data

[62] Division of Ser. No. 175,391, filed as PCT/JP92/01551, Nov. 27, 1992.

[51] Int. Cl.[6] ..... F25B 43/02

[52] U.S. Cl. ..... 62/84; 62/469; 62/502; 62/114; 252/68

[58] Field of Search ..... 62/84, 114, 502, 62/468, 470, 471; 252/68, 67

[56] References Cited

U.S. PATENT DOCUMENTS

| | | | |
|---|---|---|---|
| 3,092,981 | 6/1963 | Bergman et al. | 62/504 |
| 3,133,429 | 5/1964 | Griffin | 62/469 |
| 4,474,019 | 10/1984 | Albert | 62/468 |

FOREIGN PATENT DOCUMENTS

| | | |
|---|---|---|
| 0 490 810 | 11/1991 | European Pat. Off. . |
| 23 45 540 | 4/1975 | Germany . |

*Primary Examiner*—John M. Sollecito
*Attorney, Agent, or Firm*—Keck, Mahin & Cate

[57] ABSTRACT

The present invention provides a working fluid composition for a refrigerating machine obtained by mixing an ammonia refrigerant with a lubricating oil which is extremely excellent in solubility with the ammonia refrigerant. The working fluid composition comprises a mixture of ammonia and one or more kinds of polyether compounds; the refrigerating machine is characterized by constituting a refrigerating cycle or a heat pump cycle through which the working fluid composition is circulated.

8 Claims, 6 Drawing Sheets

WORKING FLUID COMPOSITION AND METHOD FOR LUBRICATING AMMONIA REFRIGERATING MACHINE

This application is a division of copending U.S. application Ser. No. 08/175,391, filed as PCT/JP92/01551, Nov. 27, 1992.

TECHNICAL FIELD

The present invention relates to a refrigerating machine using a refrigerant mainly comprising ammonia, a working fluid composition comprising a mixture of a refrigerant and a lubricating oil for use in a heat pump and the refrigerating machine, and a method for lubricating an ammonia compressor.

BACKGROUND ART

Heretofore, Flon has been widely used as a refrigerant for a refrigerating machine and a heat pump (hereinafter referred to generically as "the refrigerating machine"). However, when discharged into the atmosphere, the Flon is accumulated and then decomposed by ultraviolet rays of the sun to produce chlorine atoms, and these chlorine atoms destroy the ozone layer having a function to protect the earth from the intensive ultraviolet rays of the sun. For this reason, the use of the Flon is getting limited. In recent years, much attention is thus paid to ammonia as an alternative refrigerant of the Flon.

An ammonia refrigerant does not destroy the environments of the earth in contrast to the Flon, and the refrigeration effect of ammonia is comparable to that of the Flon, and what is better, ammonia is inexpensive. However, ammonia is toxic, combustible, and insoluble in a mineral oil which is used as a lubricating oil for a compressor. In addition, ammonia has the drawback that its discharge temperature of the compressor is high. Accordingly, a refrigerating system which is now utilized is constituted so as not to bring about inconveniences owing to these drawbacks.

A typical constitution of the refrigerating system will be described in reference to FIG. 6. Reference numeral 50 is a direct expansion refrigerating system of a single-step compression type for providing heat of −10° C. on the side of an evaporator and heat of +35° C. on the side of a condenser. The function of this refrigerating system will be mainly described. An oil-containing ammonia refrigerant which is compressed by a refrigerant compressor 51 is treated in an oil separator 52 to separate the oil therefrom, and it is then subjected to heat exchange with a cooling water 64 in a condenser 53 (taken heat: about 35° C.), whereby the ammonia refrigerant is condensed/liquefied in the condenser 53.

The oil liquefied and separated at the time of the condensation is further separated in an oil reservoir 55 disposed under the bottom of a high-pressure liquid receiver 54, and the ammonia refrigerant is then vaporized under reduced pressure through an expansion valve 56. In an evaporator 57, heat exchange is carried out with blast load fed by a fan 58 (taken heat: −10° C.), and the ammonia refrigerant is then sucked into the compressor 51 via an ammonia oil separator 59. Afterward, this refrigerating cycle is repeated.

The oils stored on the bottoms of the oil separator 52, the oil reservoir 55 disposed at the bottom of the liquid receiver 54, the ammonia oil separator 59 and the evaporator 57 are all collected in an oil receiver 61 via oil drawing valves 60*a*, 60*b*, 60*c* and 60*d*, respectively, and the thus collected oil is returned to the compressor 51 through an oil jet portion 52*a* of the compressor 51 to carry out lubrication, sealing and cooling of sliding parts.

In this connection, it is well known that the refrigerating machine 50 can be applied as a heat pump device by taking out heat from the side of the condenser 53, and therefore, they will be generically called the refrigerating machine.

As the above-mentioned lubricating oil, there is usually used a mineral lubricating oil comprising of a paraffinic-based oil, a naphthenic-based oil or the like. However, since the lubricating oil is insoluble in ammonia, the oil separator is provided on the discharge side of the compressor to separate the ammonia gas and the lubricating oil discharged from the compressor. Even if the above-mentioned separator is provided, the lubricating oil in a mist state cannot be completely removed. Moreover, since the discharge side of the compressor has a high temperature, the lubricating oil is slightly dissolved in ammonia or the mist of the lubricating oil is mixed with ammonia, and the lubricating oil gets into the refrigerating cycle together with ammonia and tends to accumulate in pipe passages of the cycle because of being insoluble in ammonia and having a larger specific gravity than ammonia. Therefore, oil drawing portions 55, 60*d* are must be provided at the bottom of the high-pressure liquid receiver 54 and on the lower inlet side of the evaporator 57, respectively, and the oil separator 59 must be also provided on the gas suction side of the compressor 51. In addition, the separated oil, after recovered in the oil receiver 61, is required to return to the compressor again. In consequence, the constitution is noticeably complicate.

As described above, the lubrication oil is insoluble in the refrigerant, and therefore the oil tends to adhere to wall surfaces of heat exchange coils in the condenser 53 and the evaporator 57, so that a heat transfer efficiency deteriorates. Particularly in the evaporator having a low temperature, the viscosity of the oil increases and an oil drawing fluidity lowers, so that the heat transfer efficiency further deteriorates.

Therefore, it is necessary to separate the insoluble oil on the inlet side of the evaporator 57 as much as possible. However, if the refrigerant having a reduced pressure which has passed through the expansion valve 56 is introduced from the upper portion of the evaporator 57, the lubricating oil cannot be prevented from getting into the evaporator 57 owing to a difference between specific gravities, even if a specific separator is used. For this reason, the system having the above-mentioned constitution cannot help taking the so-called bottom feed structure in which the inlet portion of the refrigerant is disposed on the bottom of the evaporator 57.

However, if the bottom feed structure is taken, the so-called full liquid structure must be naturally taken in which the refrigerant can be discharged through the upper end of the evaporator against a gravity corresponding to the height of the evaporator 57, and as a result, a large amount of the refrigerant is required in the refrigerating cycle.

In the case of the above-mentioned ammonia refrigerating system, its use is limited to about −20° C., but in recent years, the temperatures of industrial processes remarkably lower, and particularly in food fields, most of required refrigeration temperatures are −30° C. or less from the viewpoints of preventing the melting of fat at the time of thawing and keeping qualities. Particularly in the case of an expensive food such as tuna, a freezing preservation temperature is very low, in the range of −50° C. to −60° C.

Such a freezing temperature cannot be obtained by the above-mentioned single-step compressor, and in general, a two-step compressor is used. However, when the temperature of the evaporator is cooled to −40° C. or less by means of the above-mentioned conventional technique, the fluidity of the lubricating oil noticeably lowers as shown in Table 3 given below, so that the evaporator is liable to be clogged.

In order to overcome the above-mentioned drawback, such an extremely low temperature ammonia two-step compression type liquid pump recycling system as shown in FIG. 7 has been suggested.

The constitution of the suggested recycling system will be briefly described mainly in reference to differences between this recycling system and the above-mentioned conventional technique. A compressed liquid discharged from the high-pressure liquid receiver 54 to a liquid pipe 66 cools the interior of an intermediate cooler 68 by an expansion valve 67. On the other hand, the terminal end of the liquid pipe 66 is introduced into a supercooling pipe 69 in the intermediate cooler 68, and the compressed liquid is then cooled to about −10° C. in the subcooling pipe 69. Afterward, the compressed liquid is vaporized under reduced pressure by an expansion valve 74 to be introduced into a low-pressure liquid receiver 70.

As a result, the refrigerant cooled to from −40° to −50° C. or less is stored in the liquid receiver 70.

This refrigerant is introduced into an evaporator 73 via a liquid pump 71 and a flow rate regulating valve 72, and the refrigerant evaporated by heat exchange (taken heat: −40° C.) with blast load fed by a fan 74 in the evaporator 73 is introduced into the low-pressure liquid receiver 70 to be cooled and condensed/liquefied.

On the other hand, the evaporated refrigerant in the low-pressure liquid receiver 70 is sucked into a low step compressor 75 and compressed, and this compressed gas is cooled in the intermediate cooler 68 and then introduced into the supercooling pipe 69 for heat exchange in the intermediate cooler 68 to supercool the condensed refrigerant coming through the above-mentioned liquid pipe 66 to about −10° C. The thus supercooled liquid is vaporized under reduced pressure by the expansion valve 74, while introduced into the low-pressure liquid receiver 70.

The vaporized refrigerant in the intermediate cooler 68 is compressed by a high step compressor 51', and this cycle is then repeated.

Under all of the high-pressure liquid receiver 54, the intermediate cooler 68 and the low-pressure liquid receiver 70, the oil reservoirs 55, **68*a* and 70*a* are disposed, respectively, and the separated oils in these reservoirs are collected in the oil receiver 61 and then returned again to oil jet portions 51*a*, 75*a* on the sides of compressor 51' and 75. In this connection, reference numeral 76** in the drawing is a liquid surface float valve.

However, also in such a conventional technique, fundamental drawbacks such as the complication of the oil recovery constitution and the deterioration of the heat transfer efficiency cannot be overcome. Particularly on the side of the above-mentioned low-pressure liquid receiver 70, the refrigerant cooled to from −40° to −50° C. is stored, so that the lubricating oil stored in its oil reservoir is similarly cooled to from about −40° to −50° C., so that the fluidity of the lubricating oil noticeably deteriorates. Thus, when the oil is drawn, it is necessary to temporarily raise the temperature of the oil, and as a result, the continuous operation of the refrigeration cycle is disturbed. In consequence, the maintenance that the above-mentioned cycle is stopped to recover the oil is necessary, each time the oil is accumulated as much as a predetermined amount.

On the other hand, an enclosed compressor is often used in a domestic refrigerator or air conditioner, and CFC and HCFC refrigerants such as dichlorodifluoromethane (R12) and chlorodifluoromethane (R22) have been heretofore used. In the future, HFC containing no chlorine, for example, 1,1,1,2-tetrafluoroethane (R134a) will be used, but such a Flon is expensive. On the other hand, ammonia is more inexpensive than the above-mentioned Flons. In addition, ammonia is excellent in the heat transfer efficiency, has a high allowable temperature (a critical temperature) and a high allowable pressure as the refrigerant, is soluble in water to prevent the expansion valve from plugging, and has large evaporation latent heat to exert a large refrigeration effect. For these reasons, the employment of ammonia is advantageous. However, the enclosed compressor has a structure in which an electric motor and the compressor are integrally enclosed, and therefore ammonia itself corrodes copper-based materials, which makes the use of ammonia impossible. In addition, since ammonia is insoluble with the lubricating oil, it is extremely difficult to recover and recycle the oil alone. For these reasons, ammonia cannot be used nowadays.

However, if a lubricating oil which has an excellent solubility with ammonia and in which quality does not deteriorate even by a long-term use is developed, most of the above-mentioned problems will be solved.

The lubricating oil having such a solubility has already been suggested in the field of the Flon, and for example, an ester of a polyvalent alcohol and a polyoxyalkylene glycol series compound are known. However, any example of the lubricating oil for the ammonia refrigerant has not been present. Ammonia is strongly reactive, and so even when the ester slightly hydrolyzes, an acid amide is formed which causes a sludge to deposit. Moreover, these kinds of lubricating oils are poor in the solubility with ammonia, and hence it is difficult to use these lubricating oils in combination with the ammonia refrigerant.

In view of such technical problems, an object of the present invention is to provide a working fluid composition for a refrigerating machine (hereinafter referred to simply as "the working fluid composition") which is extremely excellent in the solubility with the ammonia refrigerant and which can be obtained by mixing a lubricating oil having excellent lubricating properties and stability with an ammonia refrigerant.

Another object of the present invention is to provide a refrigerating machine suitable for the above-mentioned working fluid composition.

Still another object of the present invention is to provide a method for lubricating a refrigerating machine and a refrigerating compressor mounted in the refrigerating machine by the use of the above-mentioned working fluid composition, and according to this method, the above-mentioned drawbacks of ammonia can be removed.

DISCLOSURE OF THE INVENTION

The present inventors have intensively researched in order to obtain the above-mentioned working fluid composition, and they have found that an ether compound having a specific structure in which all of the terminal OH groups of a polyoxyalkylene glycol are replaced with OR groups (hereinafter referred to simply as "the polyether") is excellent in solubility with ammonia, and that the ether compound can exert excellent lubricating properties and stability even in the presence of ammonia. In consequence, the present invention has now been completed.

That is, the first aspect of the present invention is directed to a working fluid composition which comprises a mixture of ammonia and a lubricating oil for an ammonia refrigerating compressor containing, as a base oil of the lubricating oil, a compound represented by the formula (I)

$$R_1—[—O—(PO)_m—(EO)_n—R_2]_x \quad (I)$$

wherein $R_1$ is a hydrocarbon group having 1 to 6 carbon atoms, $R_2$ is an alkyl group having 1 to 6 carbon atoms, PO is an oxypropylene group, EO is an oxyethylene group, x is an integer of from 1 to 4, m is a positive integer, and n is 0 or a positive integer.

The second aspect of the present invention is directed to a refrigeration cycle or a heat pump cycle which is constituted by putting an ammonia refrigerant and a lubricating oil into a refrigerating machine, a ratio of the lubricating oil to the ammonia refrigerant being 2% by weight or more, the lubricating oil being soluble in the ammonia refrigerant and being free from phase separation even at an evaporation temperature of the refrigerant.

In this case, the ammonia refrigerant and the lubricating oil may be previously mixed to form the working fluid composition, or they may be separately put into the refrigeration cycle or the heat pump cycle and the working fluid composition may be formed in the cycle.

Furthermore, the lubricating oil which can be used in the present invention is not limited to the lubricating oil defined in the first aspect of the present invention, and any lubricating oil is acceptable, so long as it is easily soluble in the ammonia refrigerant and does not bring about the phase separation even at the evaporation temperature of the refrigerant.

A preferable ammonia refrigerating machine using an enclosed ammonia compressor directly connected to an electric motor can be provided by disposing a stator core around a rotor so as to surround the rotor via airtight diaphragms and so as to surround the rotor via a predetermined space, and disposing an introducing portion through which the above-mentioned composition can be introduced between a space of the above-mentioned rotor and the compressor.

Furthermore, the lubricating oil in which the compound of the formula (I) is employed as the base oil is not always used only as the working fluid in which the lubricating oil is dissolved in ammonia, but it can also be used singly as a lubricating oil for the ammonia compressor. This is the third aspect of the present invention.

Next, the above-mentioned aspects of the present invention will be described in detail.

In the first place, the compound represented by the formula (I) is a polyether which is a polymer of propylene oxide, or a polyether which is a random copolymer or a block copolymer of propylene oxide and ethylene oxide.

The compound of the formula (I) is the so-called polyoxyalkylene glycol compound, and there are known many examples in which this compound is used as the lubricating oil for a refrigerating machine using HCFC or CFC as the refrigerant. For example, U.S. Pat. No. 4,948,525 (which corresponds to Japanese Patent Application Laid-open Nos. 43290/1990 and 84491/1990) suggests a polyoxyalkylene glycol monoether having the structure of $R_1—(OR_2)_a—OH$ (wherein $R_1$ is an alkyl group having 1 to 18 carbon atoms, and $R_2$ is an alkylene group having 1 to 4 carbon atoms); U.S. Pat. No. 4,267,064 (which corresponds to Japanese Patent Publication No. 52880/1986) and U.S. Pat. No. 4,248,726 (which corresponds to Japanese Patent Publication No. 42119/1982) suggest a polyglycol having $R_1—O—(R_2O)_m—R_3$ (wherein each of $R_1$ and $R_3$ is hydrogen, a hydrocarbon group or an aryl group); U.S. Pat. No. 4,755,316 (which corresponds to Japanese Patent Disclosed Publication No. 502385/1990) suggests a polyalkylene glycol having at least two hydroxyl groups; U.S. Pat. No. 4,851,144 (which corresponds to Japanese Patent Application Laid-open No. 276890/1990) suggests a combination of a polyether polyol and an ester; and U.S. Pat. No. 4,971,712 (which corresponds to Japanese Patent Application Laid-open No. 103497/1991) suggests a polyoxyalkylene glycol having one hydroxyl group obtained by copolymerizing EO and PO. In all of these publications, it is described that the solubility of these lubricating oils in HFC and HCFC is excellent.

On the other hand, the present applicant has filed Japanese Patent Application Laid-open Nos. 259093/1989, 259094/1989, 259095/1989 and 109492/1991 regarding polyoxyalkylene glycol monoethers and polyoxyalkylene glycol diethers having structures of $R_1—O—(AO)_n—H$ and $R_1—O—(AO)_n—R_2$ as the lubricating oils of the compressors for HFC.

However, these known publications do not refer to any relation with ammonia. In view of the fact that HFC and HCFC are inactive, the fact that ammonia is largely reactive, and the fact that both of them are quite different from each other in solubility, the above-mentioned pieces of the information are not useful for the completion of the present invention using the ammonia refrigerant.

With regard to the ammonia refrigerant, it is described in "Synthetic Lubricant and Their Refrigeration Applications", Lubrication Engineering, Vol. 46, No. 4, p. 239–249 that poly-α-olefin and isoparaffinic mineral oils having high viscosity indexes are useful as the lubricating oils for the ammonia refrigerant, and an ester produces a sludge and solidifies by a long-term use. In addition, U.S. Pat. No. 4,474,019 (which corresponds to Japanese Patent Application Laid-open No. 106370/1983) suggests the improvement of a refrigerating system using an ammonia refrigerant. However, also in these known publications, there is not described any relation between the ammonia refrigerant and the polyether compound.

The polyether of the formula (I) has a viscosity necessary as the lubricating oil, and in compliance with its use, it can have a viscosity of 22–68 cSt at 40° C. or 5–15 cSt at 100° C. A factor which has a large influence on this viscosity is molecular weight, and the molecular weight necessary to attain the above-mentioned viscosity is preferably in the range of 300 to 1800.

The polyether of the formula (I) is an polyether in which all of the terminals are sealed with $R_1$ and $R_2$. Here, $R_1$ is a hydrocarbon group having 1 to 6 carbon atoms, and this hydrocarbon group means the following (i) or (ii). That is, $R_1$ is (i) a saturated straight-chain or branched hydrocarbon group having 1 to 6 carbon atoms, typically an alkyl group having 1 to 6 carbon atoms derived from an aliphatic monovalent alcohol having 1 to 6 carbon atoms, that is, any one of a methyl group, an ethyl group, a propyl group, an isopropyl group, a butyl group, an isobutyl group, a pentyl group, an isopentyl group, a hexyl group and an isohexyl group. In particular, $R_1$ is preferably an alkyl group having 1 to 4 carbon atoms, more preferably an alkyl group having 1 to 2 carbon atoms, that is, a methyl group or an ethyl group. And, $R_1$ is (ii) a hydrocarbon residue derived from a divalent to a tetravalent saturated aliphatic polyvalent alcohol, typically ethylene glycol, propylene glycol, diethylene glycol, 1,3-propanediol, 1,2-butanediol, 1,6-hexanediol, 2-ethyl-1,3-hexanediol, neopentyl glycol, trimethylolethane, trimethylolpropane, trimethylolbutane or pentaerythritol, that is, a hydrocarbon group in which all the hydrogen atoms of 2 to 4 hydroxyl groups in the divalent to the tetravalent alcohol are substituted. Therefore, x of the formula (I) is an integer of from 1 to 4 corresponding to the valence of the alcohol which is the source compound of the hydrocarbon group of the above-mentioned $R_1$. In order to particularly increase the solubility of the lubricating oil in ammonia, it is preferred that x is 1 and $R_1$ is a methyl group or an ethyl group.

Furthermore, $R_2$ is an alkyl group having 1 to 6 carbon atoms. If the alkyl group having 7 or more carbon atoms is used, the phasic separative temperature of the lubricating oil and ammonia is caused rises, so that the objects of the present invention cannot be achieved. If $R_2$ is the alkyl group having 1 to 4 carbon atoms, moreover, 1 to 2 carbon atoms, the solubility of the lubricating oil with ammonia increases, that is, the phasic separative temperature further lowers preferably. If x is from 2 to 4, $R_2$ are 2 to 4 alkyl groups. These alkyl groups may be same or different, and in order to maintain the preferable solubility, $R_2$ is preferably the alkyl group having 1 to 4 carbon atoms, particularly preferably 1 to 2 carbon atoms.

Generally speaking, as the number of the carbon atoms in $R_1$ and $R_2$ increases, the phase separation temperature of the lubricating oil and ammonia tends to increase. Therefore, in order to maintain the good solubility, the total number of the carbon atoms of $R_1$ and $R_2$ is preferably 10 or less, more preferably 6 or less, further preferably 4 or less, most preferably is 2. In the case that one or both of $R_1$ and $R_2$ are hydrogen, the lubricating oil reacts with ammonia to form a sludge, with the result that the object of the present invention cannot be achieved.

If only a portion of the hydroxyl groups of the monovalent to the tetravalent alcohol remains unreacted in the synthesis of the compound of the formula (I), the obtained polyether will unpreferably form the sludge during a use for a long time. Therefore, it is preferable that the remaining hydroxyl groups of the alcohol are as little as possible, and typically, a hydroxyl value of the compound having the formula (I) is 10 mg KOH/g or less, preferably 5 mg KOH/g or less.

As described above, the viscosity of the lubricating oil in which the polyether compound represented by the formula (I) is used as the base oil is in the range of from 22 to 68 cSt at 40° C., or from 5 to 16 cSt at 100° C. This viscosity is necessary to maintain good lubricating properties under the coexistence with ammonia. In order to maintain the good solubility of the lubricating oil in ammonia, the average molecular weight of the lubricating oil is preferably in the range of from 300 to 1800. If the average molecular weight of the lubricating oil is less than 300, the viscosity is low, so that the good lubricating properties cannot be obtained. On the other hand, it is more than 1,800, the solubility with ammonia is poor. The control of the average molecular weight can be achieved by suitably selecting $R_1$ and $R_2$, and polymerization degrees m and n.

Furthermore, a relative ratio between the polymerization degree (m) of the oxypropylene group and the polymerization degree (n) of the oxyethylene group, i.e., a value of m/(m+n), is important for the lubricating properties, a low-temperature fluidity and the solubility with ammonia. That is, n is too large with respect to m, a pour point is high and the solubility with ammonia deteriorates. In view of this viewpoint, the value of m/(m+n) is preferably 0.5 or more. A compound of the formula (I) in which n is 0 is excellent in the solubility with ammonia and the lubricating properties. However, a polyether which is a copolymer of oxypropylene (PO) and oxyethylene (EO) and which m/(m+n) is 0.5 or more maintains the better solubility and has the more improved lubricating properties than a monopolymer of oxypropylene (PO). On the other hand, a polyether obtained by polymerizing oxyethylene alone or polymerizing oxyethylene and oxypropylene in a larger amount of oxyethylene has the high pour point and a high hygroscopicity, and therefore care should be taken to avoid such results. On the viewpoints of the solubility with ammonia, the lubricating properties and the fluidity, the value of m/(m+n) is preferably in the range of from 0.5 to 1.0, more preferably from 0.5 to 0.9, most preferably from 0.7 to 0.9.

Furthermore, as the copolymer of oxyethylene and oxypropylene, a block copolymer is shown in the formula (I) for convenience, but in practice, a random copolymer and an alternating copolymer are also acceptable in addition to the block copolymer. In the block copolymer, the bonding order of the oxyethylene portion and the oxypropylene portion is not restrictive, and in other words, either of the oxyethylene portion and the oxypropylene portion may be bonded to $R_1$. However, a polyether compound obtained by polymerizing an oxyalkylene having 4 or more carbon atoms such as oxybutylene is not preferable, because of being soluble with ammonia.

Next, the determination of the solubility with the ammonia refrigerant, i.e., the phase separation temperature, is made in compliance with a use to be selected. For example, in the case of an extremely low temperature refrigerating machine, the lubricating oil having a phase separation temperature of −50° C. or less is necessary. In the case of a usual refrigerator, the lubricating oil having that of −30° C. or less is used, and in the case of an air conditioner, the lubricating oil having that of −20° C. or less is usable.

Particularly when the lubricating oil having the low phase separation temperature is necessary, $R_1$ is most preferably a methyl group.

The compounds of the formula (I) may be used singly or in a combination of two or more thereof. For example, a polyoxypropylene dimethyl ether having a molecular weight of 800–1000 and a polyoxyethylene propylene diethyl ether having a molecular weight of 1200–1300 may be used singly or in the form of a mixture thereof in a ratio of 10:90 to 90:10 (by weight), and in this case, the viscosity of the mixture at 40° C. is in the range of from 32 to 50 cSt.

The polyether compound of the formula (I) can be obtained by polymerizing a monovalent to tetravalent alcohol having 1 to 6 carbon atoms or its alkaline metal salt as a starting material with an alkylene oxide having 2 to 3 carbon atoms to prepare an ether compound in which one terminal of the chain polyalkylene group is combined with the hydrocarbon group of the material alcohol by an ether bond and the other terminal of the polyalkylene group is a hydroxyl group, and then etherifying this hydroxyl group.

In order to etherify the hydroxyl group at the terminal of the ether compound, there are a method in which this ether compound is first reacted with an alkaline metal such as metal sodium or an alkaline metal salt of a lower alcohol such as sodium methylate to form an alkaline metal salt of the ether compound, and this alkaline metal salt is then reacted with an alkyl halide having 1 to 6 carbon atoms; and a method in which the hydroxyl group of the ether compound is converted into a halide, and the compound is then reacted with a monovalent alcohol having 1 to 6 carbon atoms.

Therefore, it is not always necessary to use the alcohol as the starting material, and a polyoxyalkylene glycol having hydroxyl groups at both terminals can also be used as the starting material. In any case, the polyether compound of the formula (I) can be prepared in a known suitable method.

The refrigerating machine oil of the present invention stably dissolves in ammonia in an extremely wide mixing ratio, and can exert good lubricating properties in the presence of ammonia.

As described below, the mixing ratio of the lubricating oil can be lowered by adding an additive such as diamond cluster, while the above-mentioned lubricating properties are kept up.

Therefore, the refrigerating machine oil of the present invention contains the compound represented by the formula (I) as the base oil, and the working fluid composition which is circulated through the refrigeration cycle or the heat pump cycle of the present invention preferably comprises ammonia and the polyether compound of the formula (I) in a ratio of 98:2 (by weight) or more.

To the lubricating oil and the working fluid composition for the refrigerating machine of the present invention, various kinds of additives can be added, if necessary. Examples of the additives include an etreme-ressure reagent such as tricresyl phosphate, an amine-based antioxidant, a benzotriazole-based metallic inactivating agent and an antifoaming agent of silicone or the like. In this case, those which do not react with ammonia to form a solid should be selected. Therefore, a phenolic antioxidant cannot be used. Furthermore, a lubricating oil which has a possibility of reacting with ammonia, for example, a polyol ester should not be added, and a mineral oil-based lubricating oil which is insoluble in ammonia should not be mixed.

Next, reference will be made to the second aspect of the present invention in which the above-mentioned working fluid composition is used. In this aspect of the present invention, an ammonia refrigerant and a lubricating oil which is soluble in the ammonia refrigerant and which does not bring about the phase separation at the evaporation temperature of the refrigerant are put into a refrigerating machine so as to form a refrigeration cycle or a heat pump cycle, and the ratio of the lubricating oil to the ammonia refrigerant is 2% by weight or more.

The ratio between ammonia and the lubricating oil depends upon the kind of compressor, but fundamentally, it is preferable to decrease the amount of the lubricating oil as much as possible for the sake of improving a heat transfer efficiency, so long as a lubricating performance is maintained.

For example, in the refrigerating machine using a rotary compressor of the present invention, even if the blend weight ratio of the ammonia refrigerant and the lubricating oil is set to about 70–97:30–3, sufficient lubricating properties and a refrigerating capacity can be obtained, and the undermentioned performances can be remarkably improved.

That is, if 3% or more of the oil is dissolved in ammonia, the dissolved oil is liable to get into sliding portions of the compressor, whereby a scratch can be decreased and the refrigerating cycle constitution can be extremely simplified.

In addition, when ultrafine diamond having an average particle diameter of 150 Å or less, preferably 50 Å or less or ultrafine diamond covered with graphite is added to the lubricating oil constituting the working fluid composition, the blend ratio of the lubricating oil can be lowered to about 2% without any problem.

As such diamond, there is preferably used cluster diamond obtained by exploding an explosive substance in an explosion chamber filled with an inert gas to synthesize ultrafine diamond, and then purifying the same, or carbon cluster diamond obtained by covering the cluster diamond with graphite, for example, as described in New Diamond, "Characteristics of Ultrafine Diamond Powder by New Explosion Method and its Application", Vol. 8, No. 1, 1991. When 2–3% by weight of this kind of diamond is added to the lubricating oil, the blend ratio of the lubricating oil in the working fluid can be lowered to 2% by weight.

Furthermore, the above-mentioned lubricating oil does not give rise to the phase separation even at the evaporation temperature of the refrigerant and is excellent in low temperature fluidity, and hence there is not the fear that the separated oil adheres to heat exchange coils not only on the condenser side but also on the evaporator side. In consequence, the heat transfer efficiency can largely improved and it is not necessary to dispose the oil recovery mechanism and the oil separator in the above-mentioned refrigerating cycle, whereby a circuit constitution can also be largely simplified.

In the compressor, the lubricating oil is dissolved in the refrigerant and gets into the sliding portions, which is useful to further prevent the scratch.

In this case, another constitution may be made so that the working fluid obtained by mixing the ammonia refrigerant and the lubricating oil which has been compressed by the above-mentioned compressor may be circulated through the refrigerating cycle and the heat pump cycle without interposing the oil recovery device.

In this case, even if the blend ratio of the lubricating oil is 10% by weight or more, a certain amount of the lubricating oil is stored in the compressor, and therefore the blend ratio of the lubricating oil in the refrigerating cycle, particularly the blend ratio of the lubricating oil in the working fluid composition in the evaporator can be set to 7% or less, whereby a more preferable heat transfer efficiency can be obtained.

Still another constitution may be made so that a part of the lubricating oil in the working fluid composition which has been compressed by the compressor can be returned to the compressor. Particularly in the latter case, the blend ratio of the lubricating oil can be easily increased on the side of the compressor, and the blend ratio of the lubricating oil which is introduced into the circulating cycle, particularly the side of the evaporator can be easily decreased as much as possible.

Needless to say, the present invention is applicable not only to the single-step compression type refrigerating machine but also to the two-step compressor type refrigerating machine.

The above-mentioned composition has excellent lubricating properties and solubility even the evaporation temperature or less of the refrigerant, and therefore a top feed structure can be taken in which the composition passed through the expansion valve or the intermediate cooler is introduced into the evaporator through its top side, whereby it is unnecessary to employ the so-called liquid full structure. In consequence, the amount of the refrigerant (composition) to be circulated can be reduced and the high refrigerating effect can be obtained.

Furthermore, the composition is soluble with the lubricating oil even at the evaporation temperature or less of the refrigerant, but there is the fear that the composition is separated under severe conditions of the low-temperature vaporization in the compressor. In addition, if the evaporator has the top feed constitution, the separated oil is directly introduced into the compressor to cause problems of knocking and the like.

Thus, it is preferable to dispose an oil reservoir for temporarily storing the separated oil, for example, as the double riser, in the middle of an introductive pipe passage connecting the evaporator to the compressor and a remixing portion for remixing the lubricating oil in the oil reservoir with the working fluid composition to be introduced into the compressor in the pipe passage.

The employment of the above-mentioned constitution can solve the problem regarding the insolubility of the lubricating oil in ammonia as the refrigerant.

The problems regarding the strong corrosive properties and the electrical conductivity of ammonia are not solved yet, and in particular, the problem of the corrosive properties to a copper material still remains. If this problem is not solved, it is difficult to apply ammonia to an enclosed compressor, particularly a domestic refrigerator.

Thus, the present invention provides an ammonia refrigerating machine using an enclosed ammonia compressor in which an electric motor is directly connected to the ammonia refrigerant compressor, said ammonia refrigerating machine being characterized by disposing a stator core around a rotor on the side of the electric motor via an airtight sealing portion formed on the side surface of the stator core so as to surround the rotor via a predetermined space, and disposing an introducing portion through which the above-mentioned composition can be introduced between a space in the above-mentioned rotor and the compressor.

According to the present invention, the side of the rotor provided with windings is isolated from a rotor receiving space into which the ammonia refrigerant and the like flow, by the airtight sealing portion, and therefore the windings and the like are not attacked. In addition, the composition containing the lubricating oil flows through the rotor receiving space side, so that the lubrication of bearings of the rotating shaft of the rotor and the like is not impaired and the pressure of the fluid composition in both the spaces can be uniformed.

In this case, the above-mentioned airtight sealing portion may be constituted by cylindrical can for surrounding the rotor, but in the case that the can is used, an alternating magnetic flux by the excitation of a rotor coil becomes a revolving flux and penetrates the can in the above-mentioned space to revolve the rotor. However, eddy current flows in the can to generate an eddy-current loss, which occupies about half of a motor loss, heats the motor and deteriorates its efficiency.

Thus, the stator core can be constituted as a pressure-resistant enclosed structure container. Furthermore, an insulating thin film can be formed on the inner periphery of the stator core, or a seal member can be arranged on the front surface of the stator core which confronts the rotor in which the windings of the stator core have been inserted into open grooves, and the open grooves may be constituted via the seal member so as to be capable of airtightly sealing.

In consequence, the above-mentioned drawbacks of the can are solved, and since the stator core itself functions as a pressure-resistant container, the can is unnecessary. In addition, the stator core is made of thick field cores, and hence sufficient pressure-resistant strength can be given.

When a constitution is made so that the composition can leak through a transmission shaft portion for transmitting the revolution of the rotor to the compressor side, the electric motor side can be easily lubricated and its constitution is easy, because the sealing is incomplete.

BEST MODE FOR CARRYING OUT THE INVENTION

Figures 1, 1A:
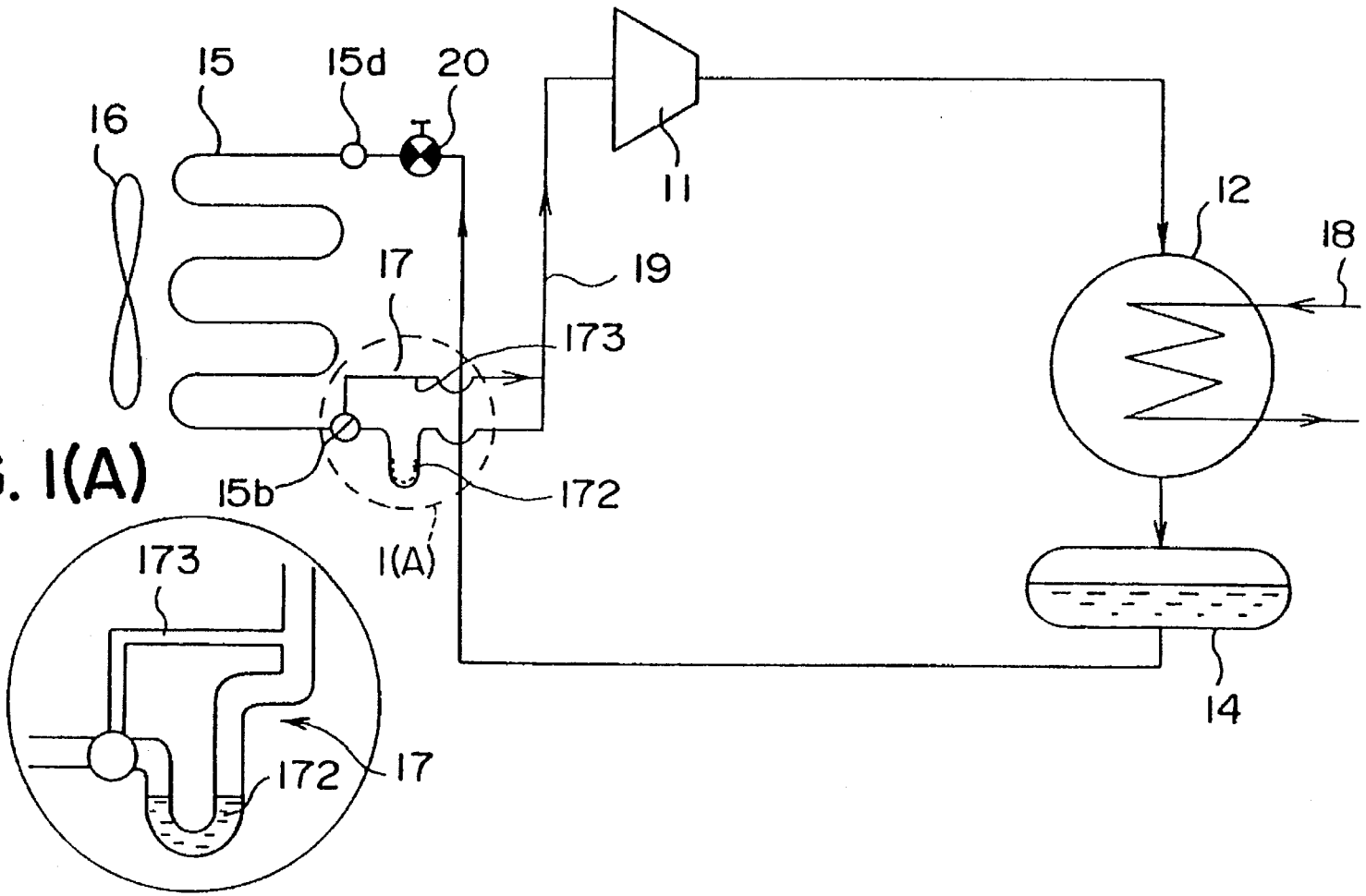
FIG. 1 is a schematic view showing a direct expansion refrigerating machine of a single-step compression type regarding an embodiment of the present invention.

In the first place, as a lubricating oil, there were used polyether compounds (Examples 1 to 8) shown in Table 1, a naphthenic mineral refrigerating oil (Comparative Example 1), a branched alkylbenzene (Comparative Example 2) and (poly)ether compounds (Comparative Examples 3 to 8) shown in Table 2, and evaluation was made by measuring solubility with ammonia, falex seizure load, color total acid numbers and the change of appearance of samples before and after bomb tests under an ammonia atmosphere.

In this connection, physical properties of the naphthenic mineral refrigerating oil in Comparative Example 1 and the branched alkylbenzene in Comparative Example 2 in Table 2 were as follows:

| | Naphthenic Mineral Refrigerating Oil | Branched Alkylbenzene |
|---|---|---|
| Density | 0.888 | 0.870 |
| Kinematic Viscosity cSt (100° C.) | 4.96 | 4.35 |
| Flash Point (°C.) | 180 | 178 |

Furthermore, the procedures of each test used in the evaluation of compositions of the present invention were as follows:

Average molecular weight: average molecular weight was measured by GPC (gel penetration chromatography).

Kinematic viscosity: This was measured in accordance with JIS K 2283.

Solubility with ammonia: 5 g of a sample oil and 1 g of ammonia were placed in a glass tube, and then cooled at a rate of 1° C. per minute from room temperature, whereby a temperature at which the phase separation occurred was measured.

Falex seizure load: This was measured in accordance with ASTM D-3233-73.

Bomb test: 50 g of a sample oil was poured in a 300 ml bomb in which 3 m of an iron wire having a diameter of 1.6 mm was placed as a catalyst, and the bomb was pressurized up to 0.6 kg/cm$^2$G with ammonia and further pressurized up to 5.7 kg/cm$^2$G with a nitrogen gas. Afterward, the sample was heated up to 150° C. and then maintained at this temperature for 7 days. After it was cooled to room temperature, ammonia was removed from the sample oil under vacuum condition. In this case, color and total acid number of the sample were measured before and after the test. The stability of the sample under the ammonia atmosphere was evaluated by the change of its appearance. In this connection, the evaluation of the appearance was graded as follows:

No change: In the case that the appearance did not change before and after the test.

Solidification: In the case that the sample solidified after the test.

The results of the test are set forth in Tables 1 and 2.

It is apparent from the results in Tables 1 and 2 that the polyether compounds in Examples 1 to 8 are excellent in solubility with ammonia, lubricating properties and stability under the ammonia atmosphere. The mixtures of these polyether compounds and ammonia can exert their functions, when put into an ammonia compressor and then used. As a result, the ammonia compressor can take a compact and maintenance-free constitution, and therefore the applications of the ammonia compressor can be effectively increased.

However, the naphthenic mineral refrigerating oil, the branched alkylbenzene and the (poly)ethers in Comparative Examples 3 to 8 shown in Table 2 are insoluble at room temperature or have the solubility at a low temperature of −50° C., but they solidify in the bomb tests. As a result, these oils cannot be used in a refrigerating cycle in which compression, condensation and expansion are repeated.

Next, reference will be made to the refrigerating system using a working fluid composition in which a lubricating oil and an ammonia refrigerant are mixed.

FIG. 1 shows a direct expansion refrigerating machine of a single-step compression type regarding the embodiment of the present invention, and a refrigerating cycle is fed with R-717 (the ammonia refrigerant) as the refrigerant and the polyether in Example 1 as the lubricating oil in a ratio of 90 parts by weight:10 parts by weight.

In this drawing, reference numeral 11 is a refrigerant compressor, and the refrigerant working fluid formed by mutually dissolving the ammonia refrigerant compressed in the refrigerant compressor 11 and the lubricating oil is directly led to a condenser 12 without passing through an oil separator, and then condensed/liquefied by heat exchange (taken heat: 30° C. or so) with cooling water in the condenser 12.

The thus condensed working fluid is stored in a high-pressure liquid receiver 14, evaporated under reduced pressure by means of an expansion valve 13, introduced into an evaporator 15 through an inlet 15*a* provided at the upper end of the evaporator 15 in accordance with top feed, heat-exchanged with blast load fed by a fan 16 (taken heat: −15° to −20° C. or so), and then sucked on the gas suction side of the compressor 11 via a double riser 17. Afterward, the above-mentioned refrigerating cycle is repeated.

Here, the double riser 17, as already known, has a main pipe passage 171 having a U-shaped local oil reservoir 172 on the outer side of an outlet 15*b* of the evaporator 15 and a by-pass pipe passage 173 for by-passing the main pipe passage. Thus, the oil slightly separated by evaporation in the evaporator 15 is stored in the oil reservoir 172 and simultaneously led to a low-pressure sucking pipe 19 via the main pipe passage 171. The by-pass pipe passage 173 is constituted in the form of a thin pipe to give a chock resistance. Thus, when the main pipe passage 171 is clogged by the oil reservoir, the clogging oil is led to the low-pressure sucking pipe 19 by the flow rate of the evaporated refrigerant containing the lubrication oil which flows through the by-pass pipe passage 173, so that they are mixed and dissolved again, and then led to the suction side of the compressor 11.

Figure 6:
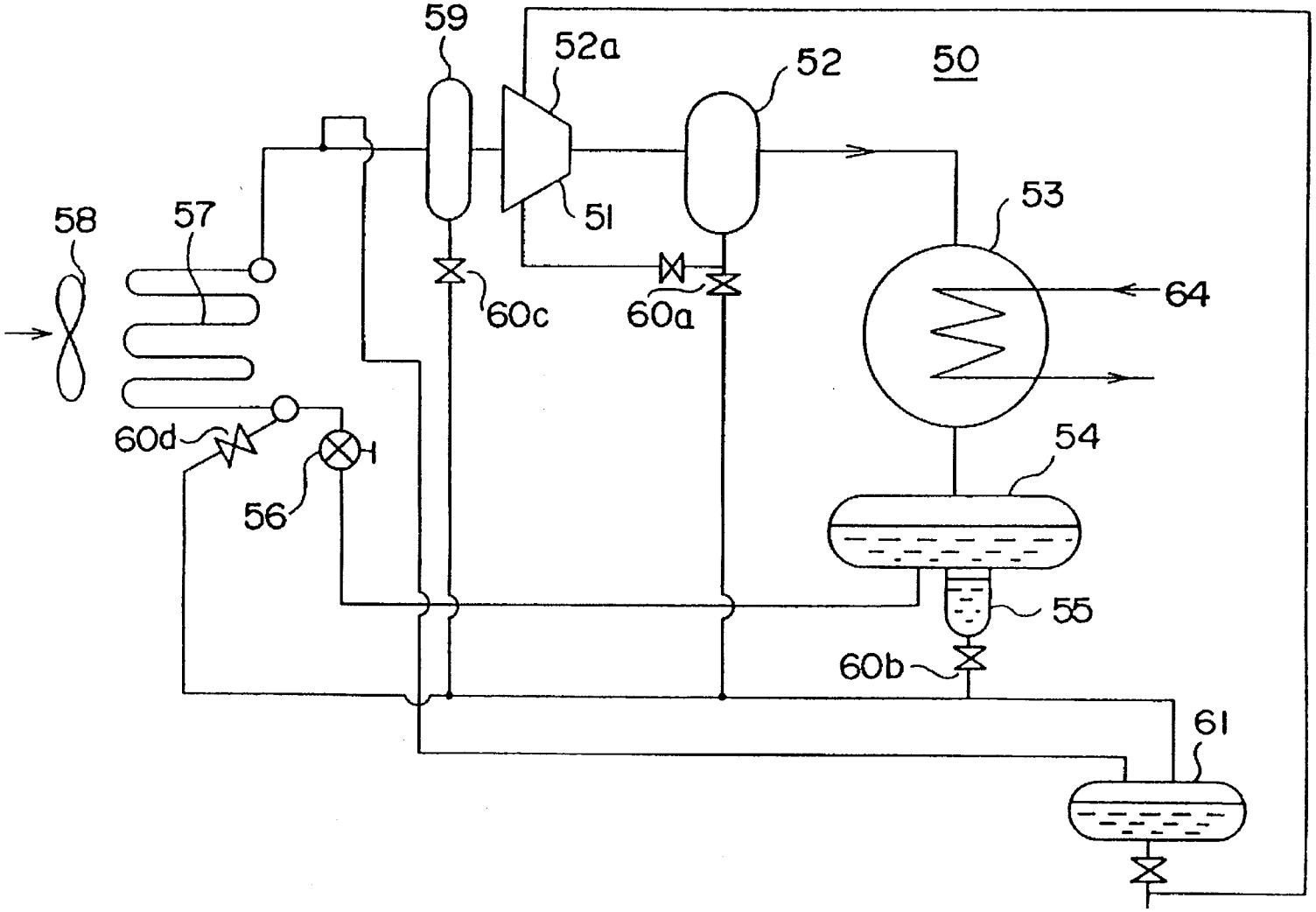
FIG. 6 is a schematic view showing a direct expansion refrigerating machine of a single-step compression type regarding a conventional technique.

Therefore, according to this embodiment, an oil separator and the like are unnecessary, and it is also unnecessary to provide any oil reservoir on the bottom of the liquid receiver as in the case of a conventional technique shown in FIG. 6. Furthermore, the local oil reservoir 172 is provided in the double riser 17, whereby the mixing and solution are carried out again and the mixture is introduced into the compressor 11. Thus, an oil recovery mechanism and a return circuit for returning to the side of the compressor 11 again are unnecessary, whereby the cycle constitution can be extremely simplified.

In the present embodiment, the refrigerant is soluble with the lubricating oil even at an evaporation temperature or less, and therefore the top feed can be taken in which the refrigerant having a reduced pressure passed through the expansion valve 13 is introduced into the evaporator 15 through the upper portion of the evaporator 15. In consequence, the refrigerant can pass through the evaporator by gravity, and it is unnecessary to take the so-called liquid full structure. According to experiments of the present inventors, even if the amount of the refrigerant was decreased as much as 10% or more as compared with the conventional example shown in FIG. 6, a higher refrigerating effect than the above-mentioned conventional example could be obtained.

In the present embodiment, even if the ammonia refrigerant and the lubricating oil are fed in a ratio of 90 parts by weight:10 parts by weight, a certain amount of the lubricating oil is stored in the compressor 11 and therefore the weight ratio of the working fluid composition which circulates through the refrigerating cycle is lower than the above-mentioned feed weight ratio. In particular, a blend ratio circulating through the evaporator is 5% or less, and therefore the heat transfer efficiency on the evaporation side can be further improved.

In this connection, the above-mentioned compressor is suitable for a variable blade type rotary compressor or a reciprocating compressor.

In the present embodiment, operation is carried out at an evaporation temperature of from −15° to −20° C. at a higher compression ratio than the above-mentioned conventional technique, but even if such a constitution is taken, the working fluid does not deteriorate and sludging does not occur, so that a high reliability can be kept up for a long period of time.

Furthermore, the lubricating oil does not adhere to the wall surfaces of heat exchange coils in the condenser 12 and the evaporator 15, and the heat transfer efficiency is improved as much as 60% or more as compared with the conventional example shown in FIG. 6 in which the naphthenic mineral refrigerating oil is used.

Moreover, since the ammonia and the lubricating oil which constitute the above-mentioned working fluid have a power to dissolve in water, a dehumidifying agent such as silica gel and a dehumidifying mechanism do not have to be provided as in a Flon refrigerating cycle.

In the above-mentioned working fluid, it is necessary to increase the ratio of the refrigerant in a range in which the lubricating properties of the compressor 11 do not decline, but if the amount of the lubricating oil is lowered to 5% by weight or less, a lubricating power actually deteriorates.

In such a case, 2 to 3% by weight of cluster diamond or carbon cluster diamond obtained by covering the cluster diamond with graphite which has an average particle diameter of about 50 Å or less can be added to the lubricating oil to further lower the blend ratio of the lubricating oil in the above-mentioned working fluid.

Figure 3:
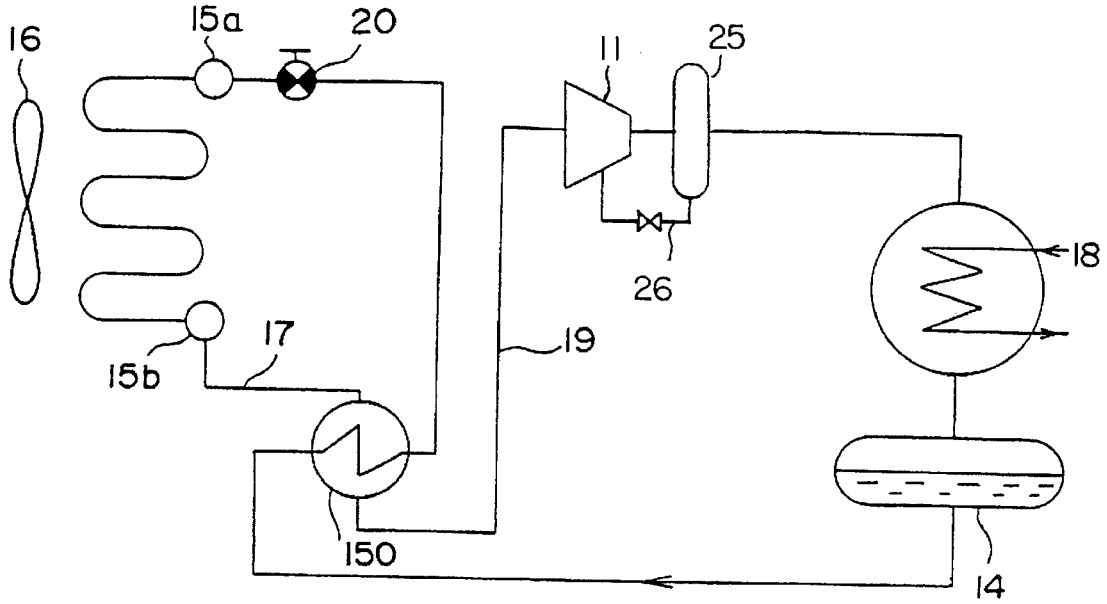
FIG. 3 is a schematic view showing a direct expansion refrigerating machine of a single-step compression type regarding another embodiment of the present invention.

In addition, as shown in FIG. 3, the liquid refrigerant passed through the condenser 14 is utilized to heat the working fluid composition containing the oil slightly separated by evaporation in the evaporator 15 by a heat exchanger 150, whereby the separated oil is dissolved in the composition again. In consequence, the double riser 17 is also unnecessary.

In order to improve the lubricating properties, the blend ratio of the lubricating oil of the working fluid composition may be increased, and an oil separator 25 and a return circuit 26 for returning the oil separated in the separator 25 to the compressor 11 again may be provided on the outlet side of the compressor.

Particularly, in the case of an oil cooling type screw compressor, the oil separator 25 and the return circuit 26 for returning the oil separated in the separator 25 to the compressor side again is preferably provided on the outlet side of the compressor 11.

In this case, even if the ammonia refrigerant and the lubricating oil are fed in a ratio of 90–80 parts by weight:10–20 parts by weight, the blend ratio of the lubricating oil in the closed cycle of the compressor 11/the oil separator 25/the return circuit 26 can be increased, and the blend ratio of the lubricating oil in another refrigerating cycle can be set to an extremely low level. For example, the ratio of the lubricating oil on the side of the compressor 11 can be set to 90% or more, and the blend ratio of the lubricating oil on the side of the evaporator 15 can be set to 3% or less, further 0.5% or so.

As shown in Examples 4, 6, 7 and 8 in the above-mentioned table, when the working fluid is prepared by using the lubricating oil whose phase separation temperature is −50° C. or less, the extremely low refrigerating machine can be simply constituted without taking a liquid pump recycling system structure.

Figure 2:
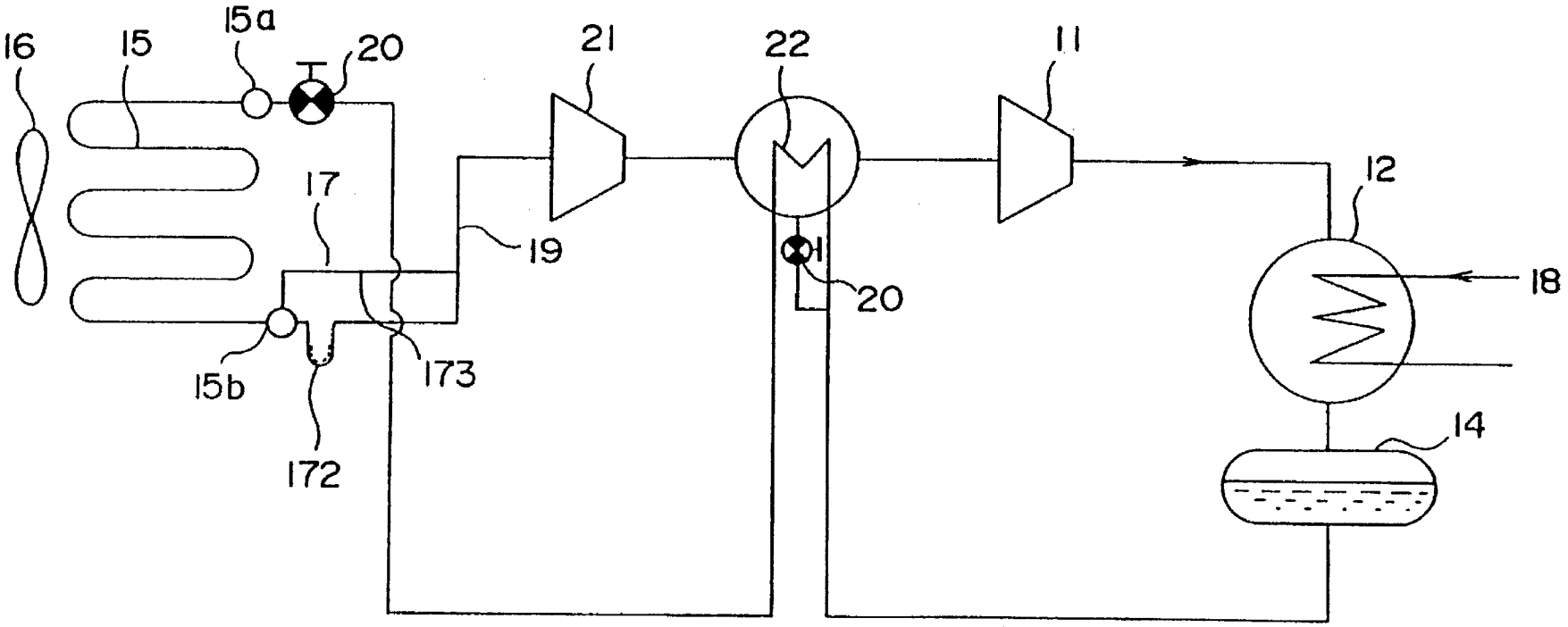
FIG. 2 is a schematic view showing an extremely low refrigerating machine of a two-step compression type regarding an embodiment of the present invention.

This constitution will be briefly described in reference to FIG. 2. FIG. 2 shows an extremely low temperature refrigerating system in which R-717 (an ammonia refrigerant) as the refrigerant and a polyether in Example 6 as the lubricating oil are fed to the refrigerating cycle in a ratio of 95 parts by weight:5 parts by weight. Reference numeral 21 is a low-step compressor. The compressed working fluid in which the ammonia refrigerant and the lubricating oil are mutually dissolved is cooled to about −10° C. in an intermediate cooler 22, and then led to a high-step compressor 11.

The refrigerant working fluid compressed in the high-step compressor 11 is directly led to a condenser 12, and the working fluid is then condensed/liquefied in the condenser 12 by heat exchange (taken heat: 35° C. or so) with cooling water (a cooling water pipe 18).

The thus condensed working fluid is stored in a high-pressure liquid receiver 14, and then vaporized under reduced pressure by an expansion valve 20 to cool the intermediate cooler 22 to about −10° C. Next, the working fluid liquefied by the cooling is introduced into an evaporator 15 through an inlet 15*a* disposed on the top of the evaporator 15, heat-exchanged with blast load fed by a fan 16 (taken heat: −15° C.), and then sucked on the gas suction side of the compressor 21 via a double riser 17. Afterward, the above-mentioned refrigerating cycle is repeated.

Figure 7:
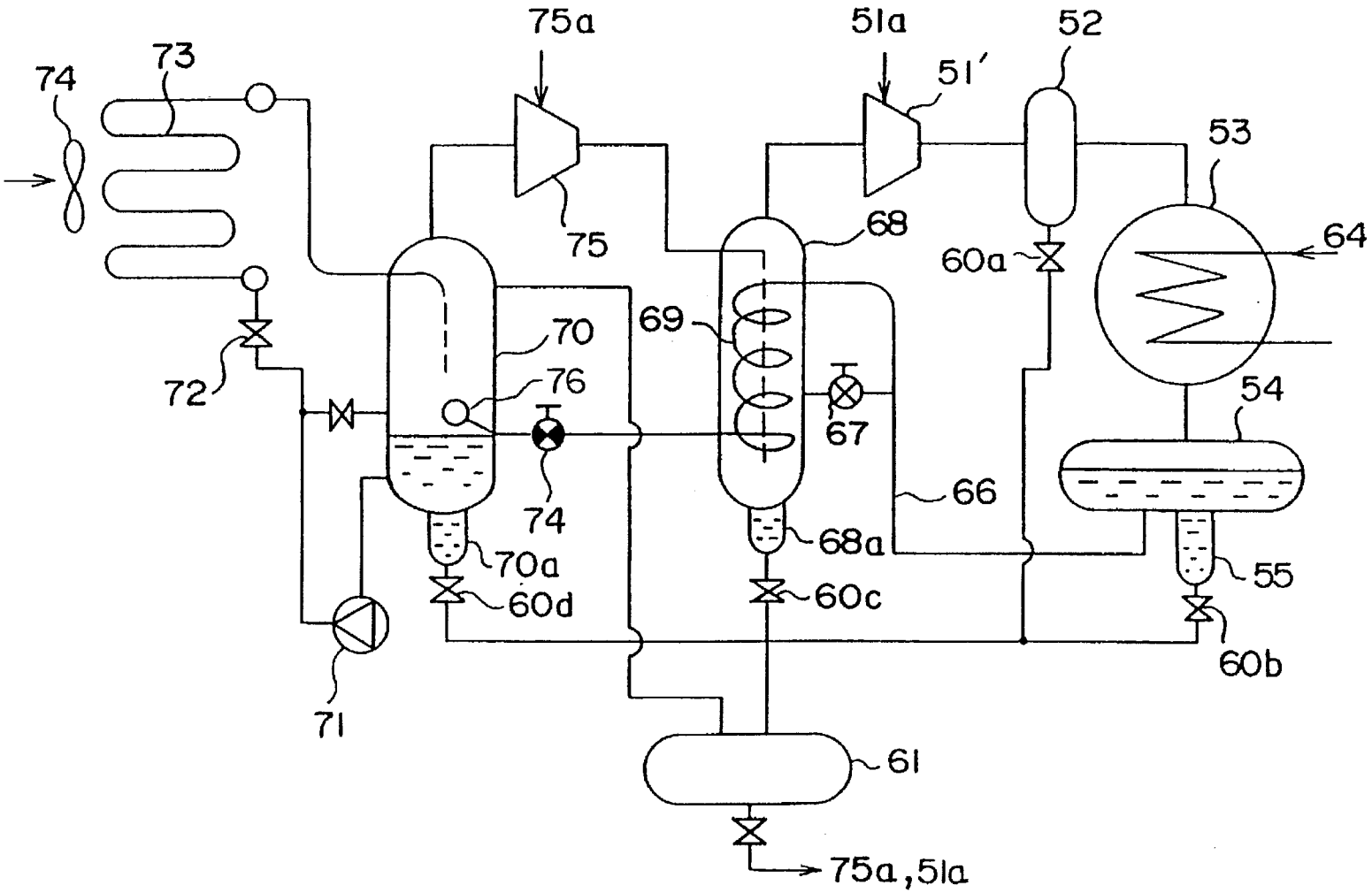
FIG. 7 is a schematic view showing an extremely low refrigerating machine of a two-step compression type regarding a conventional technique.

Therefore, also in this embodiment, an oil reservoir and an oil recovery mechanism are unnecessary in the high-pressure liquid receiver 14 and the intermediate cooler 22, and in contrast to a conventional technique shown in FIG. 7, a liquid pump recycling mechanism for recycling the refrigerant liquid between a low-pressure liquid receiver and the evaporator is unnecessary, so that the refrigerating cycling constitution can be remarkably simplified.

As shown in Table 3, the working fluid composition used in this embodiment is well soluble with the refrigerant even at −50° C. at which fluidity is an evaporation temperature or less, and fluidity is also good, about 4.5 seconds. Therefore, the top feed can be taken. Even if the amount of the refrigerant is decreased, a higher refrigerating effect can be obtained than the conventional example having a bottom feed structure. In addition, a heat transfer efficiency at an extremely low temperature in the evaporator can also be improved.

Furthermore, the handling of the oil is sufficient only by providing a local oil reservoir such as the double riser arranged on the outlet side of the evaporator 15 and a remixing/dissolving structure. Thus, the refrigerating cycle can be continuously driven for a long period of time without temporarily stopping the cycle for the oil drawing, whereby operators and maintenance can be easily omitted.

By employing the above-mentioned constitution, the problem based on the insolubility of oil in the refrigerant can be solved.

However, the problems regarding the strong corrosive properties and the electrical conductivity of ammonia are not solved yet, and in particular, the problem of the corrosive properties to an electrical copper wire still remains. If this problem is not solved, it is difficult to apply ammonia to an enclosed compressor, particularly a domestic refrigerator.

A first solution is to apply a canned motor.

That is, in the enclosed motor directly connected to a fluid machine using the ammonia refrigerant, the employment of a can type motor is investigated in which a cylindrical can is inserted and fix between a stator and a rotor to prevent the ammonia refrigerant from leaking to the stator arranged on the outer periphery of the can.

However, in the can, a high-density alternating magnetic flux interlinks, and an eddy-current loss and a magnetic resistance in a space inclusive of the can increase. In addition, a large amount of heat is generated owing to excitation loss and the like, so that the efficiency of the canned motor deteriorates.

Thus, if the stator is separated from the rotor and the side of the stator is sealed to prevent the leakage of ammonia without using the can, any particular problem is not present.

Figure 4:
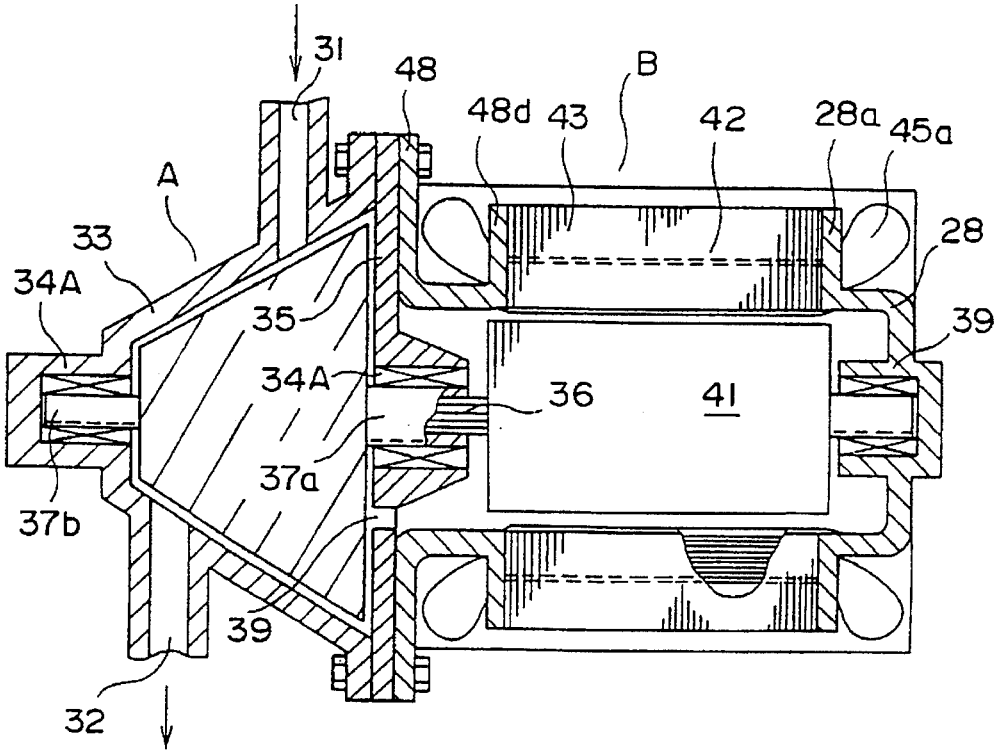
FIG. 4 is a vertical section of an enclosed compressor directly connected to an electric motor regarding an embodiment of the present invention.
Figure 5:
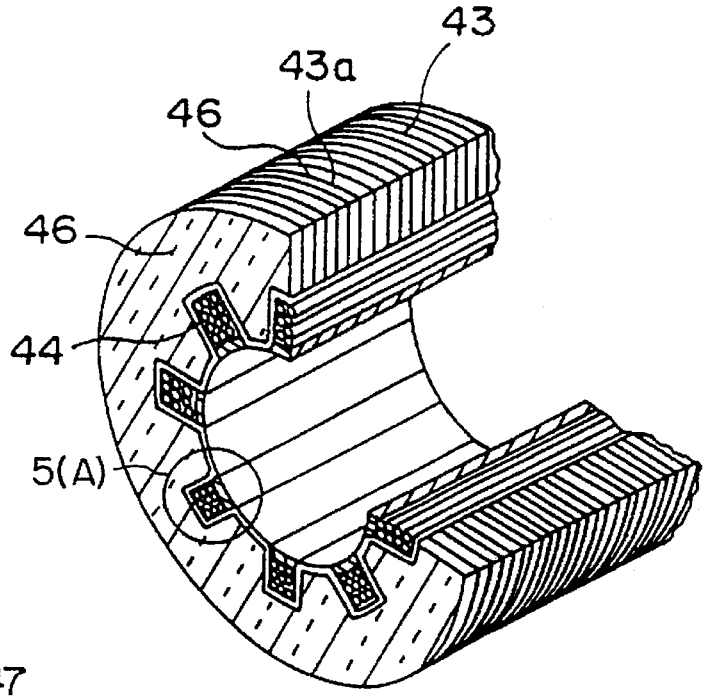
FIG. 5(A) and (B) is an enlarged view of the main portion showing a sectional structure of a stator in FIG. 4.

FIGS. 4 and 5 are concerned with an embodiment of such a constitution, and they show the constitution of an enclosed compressor in which a motor is directly connected to a screw compressor. In the first place, the constitution on the side of a screw compressor A will be described. Reference numeral 31 is a sucking orifice for introducing the above-mentioned soluble working fluid which will be compressed, as indicated by an arrow; numeral 32 is an outlet for discharging the refrigerant gas compressed by a screw rotor 30 to the side of the condenser; 33 is a rotor housing for covering them; 34A is a bearing inserted into a disc bearing housing 35 and supports a rotor shaft 37*a* into which a rotating shaft 36 is inserted via a sprocket shaft. Moreover, a rotor shaft 37*b* on the other side is supported by a bearing 34B.

In this case, an incomplete sealing state is established between the rotor shaft 37*a* and the bearing 34A so that the working fluid composition may be introduced from the compressor A side to the motor B side. Furthermore, a return hole 39 of the working fluid which has flowed to the motor B side is provided under the disc bearing housing 35 to uniform the pressure of the space in the rotor 41 on the compressor A side and the motor side.

On the other hand, the motor B side is equipped with a rotor 41 fixed by the above-mentioned rotating shaft 36 and a stator 42 surrounding the rotor 41. As shown in FIG. 5, the stator 42 is composed of stator core 43 comprising many laminated field core plates 43*a* and windings 45 received in U-shaped open grooves 44 extending in an axial direction. Reference numeral 45*a* is a prolonged coil of each of the windings which are arranged on both the sides in the axial direction.

The above-mentioned stator core 43 is formed by applying an insulating resin coating material or another additive 46 onto the surfaces of the many laminated field core plates 43*a* and then airtightly sealing them, or by interposing thermally meltable insulating films 46 between the field core plates 43*a* and then thermally pressing them to integrally solidify them and to keep a pressure-resistant and airtight state. In addition, a non-magnetic thin plate 47 or a resin thin film 47 is formed on the inner periphery of the stator core 43 by pressing so as to cover the same, whereby the above-mentioned airtight state can be further improved.

The above-mentioned stator core 43 is substantially cylindrical, and both the ends of the stator core 43 in the axial direction are integrally airtightly secured to a flange 48*a* of an outer frame housing 48 airtightly fixed to the bearing housing 35 on the side of the compressor A and a flange 28*a* of a mirror plate-like housing 28 integrally associated with a bearing 29 on the free end side of the rotating shaft 36.

According to the above-mentioned constitution, as just described, both the ends of the stator core 43 are integrally secured to the outer frame housing 48 airtightly fixed to the side of the compressor A and the mirror plate-like housing 28 positioned on the free end side of the rotating shaft 36, and therefore the stator core 43 can be utilized as a pressure-resistant container by a cooperative function with these members. Therefore, the stator core 43 can hold so sufficient pressure resistance as to withstand the refrigerating machine in which the compression of the refrigerant gas is as high as 20 $Kg/m^2$.

On the other hand, the windings 45 received in the open grooves 44 of the stator core 43 are arranged in the same space as the rotor 41, and therefore the working fluid composition containing the corrosive ammonia refrigerant gets into the motor B through the incompletely sealed space between the rotor shaft 37*a* of the compressor A and the bearing 34. Thus, it is necessary to subject the rotor 41 and the windings 45 to an anti-corrosive insulating treatment, but the anti-corrosive insulating treatment of the windings is very difficult.

Figure 5A:
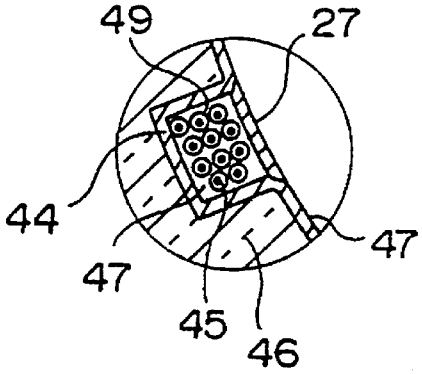
Figure 5B:
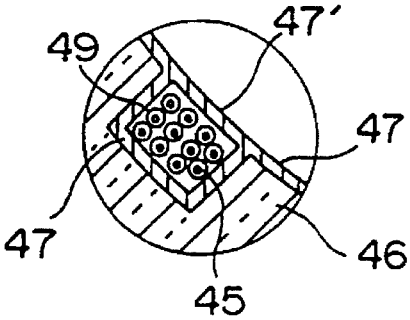

Hence, as shown in FIG. 5(B), the open grooves 44 are filled with a binder resin 49 and insulating resin thin films 47' are then applied to their inner peripheries to airtightly seal the open grooves 44. Alternatively, as shown in FIG. 5(A), the open grooves 44 are filled with the binder resin and seal plates 27 having both tapered sides are mounted on the opening ends of the open grooves 44. In this case, the pressure of the refrigerant gas in the container is applied to the back surfaces of the seal plates 27 to airtightly seal the opening ends of the open grooves 44. As a result, the stator windings 44 in the open grooves 12 are fixed and the opening surfaces of the open grooves are closed, whereby tough mechanical strength, anti-corrosive properties and airtightness can be simultaneously held.

Possibility of Industrial Utilization

A lubricating oil and a working fluid composition for a refrigerating machine of the present invention have an excellent soluble stability to ammonia and exert excellent lubricating properties under an ammonia refrigerant atmosphere, and in addition, any solid is not formed during the operation of the refrigerating machine. Therefore, an oil recovery device which is necessary for a conventional refrigerating machine using the ammonia refrigerant can be omitted, which can be also applied to a small-sized refrigerator.

A refrigerating machine which is a second aspect of the present invention is constituted so that the working fluid composition comprising the lubricating oil and ammonia may be circulated through a refrigerating cycle or a heat pump cycle, whereby the constitution of the machine can be simplified and a heat transfer efficiency can be improved. Hence, the industrially extremely advantageous refrigerating machine can be provided.

Particularly in preferable examples of the present invention, problems of the insolubility of ammonia to the lubricating oil and corrosive properties of ammonia can be solved, whereby an ammonia enclosed compressor can be easily provided, and its practical value is extremely large.

TABLE 1 (I)

| | Structure or Type of Main Component Compound | Random/ Block | Average Molecular Weight |
|---|---|---|---|
| Example 1 | $CH_3O(PO)_mCH_3$ | — | 800 |
| Example 2 | $C_4H_9O(PO)_m(EO)_nCH_3$ (m:n = 8:2) | Block | 900 |
| Example 3 | $C_8H_{17}O(PO)_m(EO)_nCH_3$ (m:n = 9:1) | Random | 400 |
| Example 4 | $CH_3O(PO)_m(EO)_nCH_3$ (m:n = 7:3) | Block | 1300 |
| Example 5 | $CH_3O(PO)_mCH_3$ | — | 1000 |
| Example 6 | $CH_3O(PO)_m(EO)_nCH_3$ (m:n = 8:2) | Block | 1000 |
| Example 7 | $CH_3O(PO)_m(EO)_nCH_3$ (m:n = 3:7) | Random | 1000 |
| Example 8 | Mixture of Example 3/Example 4 = 50/50 (wt) | (mixed) | 850 |

TABLE 1 (II)

| | Kinematic viscosity cSt (100° C.) | Solubility with Ammonia (phase separation temperature °C.) | Falex Seizure Load Lbf (60° C.) |
|---|---|---|---|
| Example 1 | 7 | −34 | 760 |
| Example 2 | 9 | −40 | 800 |
| Example 3 | 3 | −45 | 690 |
| Example 4 | 14 | −50 or less | 860 |
| Example 5 | 10 | −15 | 780 |
| Example 6 | 10 | −50 | 820 |
| Example 7 | 10 | −50 or less | 850 |
| Example 8 | 6 | −50 or less | 800 |

TABLE 1 (III)

| | Condition before and after Bomb Test | | |
|---|---|---|---|
| | Color (ASTM) | Total Acid Value mgKOH/g | Appearance |
| Example 1 | L0.5/L0.5 | 0.01/0.01 | Unchanged |
| Example 2 | L0.5/L0.5 | 0.01/0.01 | Unchanged |
| Example 3 | L0.5/L0.5 | 0.01/0.01 | Unchanged |
| Example 4 | L0.5/L0.5 | 0.01/0.01 | Unchanged |
| Example 5 | L0.5/L0.5 | 0.01/0.01 | Unchanged |
| Example 6 | L0.5/L0.5 | 0.01/0.01 | Unchanged |
| Example 7 | L0.5/L0.5 | 0.01/0.01 | Unchanged |
| Example 8 | L0.5/L0.5 | 0.01/0.01 | Unchanged |

TABLE 2 (I)

| | Structure or Type of Main Component Compound | Random/ Block | Average Molecular Weight |
|---|---|---|---|
| Comparative Example 1 | Naphthenic mineral refrigerating oil | — | 400 |
| Comparative Example 2 | Branched alkyl benzene | — | 300 |
| Comparative Example 3 | $C_{12}H_{25}O(PO)_mH$ | — | 1000 |
| Comparative Example 4 | $C_4H_9O(BO)_1CH_3$ | — | 600 |
| Comparative Example 5 | $C_4H_9O(PO)_m(EO)_nCH_3$ (m:n = 8:2) | Random | 1900 |
| Comparative Example 6 | $C_{12}H_{25}O(PO)_mCH_3$ | — | 1000 |
| Comparative Example 7 | $CH_3O(PO)_m(EO)_nH$ (m:n = 8:2) | Random | 1800 |
| Comparative Example 8 | $CH_3O(PO)_mH$ | — | 1000 |

BO: Oxybutylene

TABLE 2 (II)

| | Kinematic viscosity cst (100° C.) | Solubility with Ammonia (phase separation temperature °C.) | Falex Seizure Load Lbf (60° C.) |
|---|---|---|---|
| Comparative Example 1 | 5 | Insoluble at room temperature | 450 |
| Comparative Example 2 | 4 | Insoluble at room temperature | 300 or less |
| Comparative Example 3 | 10 | Insoluble at room temperature | 780 |
| Comparative Example 4 | 5 | Insoluble at room temperature | 820 |
| Comparative Example 5 | 20 | Insoluble at room temperature | 830 |
| Comparative Example 6 | 10 | Insoluble at room temperature | 770 |
| Comparative Example 7 | 20 | −50 or less | 900 |
| Comparative Example 8 | 10 | −50 or less | 800 |

TABLE 2 (III)

| | Condition before and after Bomb Test | | |
|---|---|---|---|
| | Color (ASTM) | Total Acid Value mgKOH/g | Appearance |
| Comparative Example 1 | L0.1/L0.5 | 0.01/0.01 | Unchanged |
| Comparative Example 2 | L0.5/L0.5 | 0.01/0.01 | Unchanged |
| Comparative Example 3 | L0.5/—* | 0.01/— | Unchanged |
| Comparative Example 4 | L0.5/L0.5 | 0.01/0.01 | Unchanged |
| Comparative Example 5 | L0.5/L0.5 | 0.01/0.01 | Unchanged |
| Comparative Example 6 | L0.5/L0.5 | 0.01/0.01 | Unchanged |
| Comparative Example 7 | L0.5/—* | 0.01/— | Solidified |
| Comparative Example 8 | L0.5/—* | 0.01/— | Solidified |

*White (by observation)

TABLE 3

| | Characeristics | | |
|---|---|---|---|
| Oil | Solubility °C. (phase separation temperature) | Fluidity (sec) −30° C. | Fluidity (sec) −50° C. |
| Naphthenic Mineral Oil | Separated at Room Temperature | 103 | 300 or more |
| Example 6 | −50 | 1 or less | 4.5 |

Notes:
Solubility: $NH_3$ (1 ml) was added to the oil (5 ml) at a room temperature (a glass tube having a diameter of 11 mm), the mixture was cooled at 2–3° C./minute, and then the phase separation temperature was measured.
Fluidity: A sample (above glass tube for measuring solubility) was shaken at 0° C. for 1 minute, then keeped for 1 hour on a bath at 0° C. (vertically), after that cool down to measuring temperature then maintained 30 minutes (vertically), and after vertically inverted, a time taken until the oil flowed 50 mm was measured.

We claim:

1. An ammonia refrigerating machine characterized by constituting a refrigerating cycle or a heat pump cycle, the ammonia refrigerating machine including a working fluid composition comprising an ammonia refrigerant and a lubricating oil soluble in the ammonia refrigerant and free from two-layer separation at an evaporation temperature of the ammonia refrigerant, a ratio of the ammonia refrigerant to the lubricating oil being in a range from 70:30 to 97:3, by weight.

2. The ammonia refrigerating machine according to claim 1, which comprises an oil reservoir provided in a duct line leading from the evaporator to the compressor, for temporarily storing the lubricating oil separated on the evaporator side, and a re-mixer for re-mixing the lubricating oil in the oil reservoir with the working fluid composition to be introduced into the compressor in the duct line, the amount of the lubricating oil in the working fluid composition supplied to the compressor side being at least 10%, by weight, and the ratio of the lubricating oil in the working fluid composition supplied to the compressor to ammonia refrigerant being 7% or less, by weight.

3. The ammonia refrigerating machine according to claim 2, wherein the working fluid composition produced as a result of dissolution of the ammonia refrigerant in the lubricating oil and having passed through an expansion valve or intermediate cooler is introduced as a top feed from an inlet provided at a top of the evaporator to an outlet provided at a bottom of the evaporator.

4. An ammonia refrigerating machine characterized by constituting a refrigerating cycle or a heat pump cycle, the ammonia refrigerating machine including a working fluid composition comprising an ammonia refrigerant and a lubricating oil soluble in the ammonia refrigerant and free from two-layer separation at an evaporation temperature of the ammonia refrigerant, a ratio of the ammonia refrigerant to the lubricating oil being in a range of 70:30 to 98:2, by weight.

5. The ammonia refrigerating machine according to claim 4, wherein the lubricating oil comprises ultra-fine particles of diamond and an average particle diameter of the ultra-fine particles of diamond is 150 Å or less.

6. The ammonia refrigerating machine according to claim 5, wherein the average particle diameter of the ultra-fine particles of diamond is 50 Å or less.

7. An ammonia refrigerating machine according to claim 1, which comprises a sealed ammonia refrigerant compressor, a motor directly coupled to the sealed ammonia refrigerant compressor, and a gas-tight canned motor comprising a stator and a rotor, wherein an inner periphery of a core of the stator surrounds the rotor of the motor with a clearance provided with respect to the rotor, a passage for passing the working fluid composition being provided between the inner space in the rotor and the compressor.

8. The ammonia refrigerant machine according to claim 1, comprising a sealed ammonia refrigerant compressor and a motor directly coupled to the sealed ammonia refrigerant compressor, a stator core surrounding a rotor of the motor being a pressure-bearing sealed vessel, a seal member thereof being provided on a front side of an open groove of the stator core, which faces the stator core after insertion of windings therein, the seal member being capable of gas-tight sealing of the open groove.

* * * * *